US011033937B2

(12) United States Patent
Hattori

(10) Patent No.: US 11,033,937 B2
(45) Date of Patent: Jun. 15, 2021

(54) COLOR SORTING MACHINE

(71) Applicant: Hattori Seisakusho Co., Ltd., Kyoto (JP)

(72) Inventor: Katsuhiro Hattori, Kyoto (JP)

(73) Assignee: HATTORI SEISAKUSHO CO., LTD., Kyoto (JP)

( * ) Notice: Subject to any disclaimer, the term of this patent is extended or adjusted under 35 U.S.C. 154(b) by 0 days.

(21) Appl. No.: 16/608,886

(22) PCT Filed: Sep. 25, 2018

(86) PCT No.: PCT/JP2018/035347

§ 371 (c)(1),
(2) Date: Oct. 28, 2019

(87) PCT Pub. No.: WO2019/069742

PCT Pub. Date: Apr. 11, 2019

(65) Prior Publication Data

US 2020/0222944 A1 Jul. 16, 2020

(30) Foreign Application Priority Data

Oct. 2, 2017 (JP) ..... JP2017-192894

(51) Int. Cl.
*B07C 5/342* (2006.01)
*B07C 5/36* (2006.01)

(52) U.S. Cl.
CPC ..... *B07C 5/3422* (2013.01); *B07C 5/361* (2013.01); *B07C 5/363* (2013.01)

(58) Field of Classification Search
CPC ..... B07C 5/342; B07C 5/3425; B07C 5/3422; B07C 5/361; B07C 5/362; B07C 5/363
(Continued)

(56) References Cited

U.S. PATENT DOCUMENTS 2,267,326 A * 12/1941 Eissmann ..... A24B 5/10 209/136
4,230,559 A * 10/1980 Smith ..... B07B 4/02 209/139.1

(Continued)

FOREIGN PATENT DOCUMENTS

CN 101132867 A 2/2008
JP 2009-022870 2/2009

(Continued)

OTHER PUBLICATIONS

International Search Report dated Dec. 10, 2018 in corresponding International patent application No. PCT/JP2018/035347.

*Primary Examiner* — Terrell H Matthews
(74) *Attorney, Agent, or Firm* — Kirschstein, Israel, Schiffmiller & Pieroni, P.C.

(57) ABSTRACT

Provided is a color sorting machine capable of properly removing foreign mater even when the specific gravity of the object to be sorted is low. A color sorting machine M1 removes foreign matter F in the object to be sorted being conveyed from a conveyance route G into a removal route R. The color sorting machine M1 is equipped with a supply portion 1 supplying the object to be sorted to the conveyance route G, a sorting portion 2 surrounding a sorting region R and partially formed by transparent walls 21*a* and 21*b*, a first conveying portion 3 surrounding the periphery of the conveyance route G to the sorting region R, a second conveying portion 4 hermetically surrounding the periphery of the conveyance route G from the sorting region R, a removing portion 5 hermetically surrounding the periphery of the removal route D extending from the sorting region R, an air intake port 32, a detection device 6 optically detecting the foreign matter F in the object to be sorted, a removal device 7 having an ejection port 72 hermetically inserted into the sorting portion 2, and a first suction device 8 provided in the
(Continued)

second conveying portion 4 and sucking in the air in the conveyance route G to thereby generating an airflow heading for the second conveying portion 4 from the air intake port 32.

9 Claims, 5 Drawing Sheets

(58) Field of Classification Search
USPC ..... 209/577
See application file for complete search history.

(56) References Cited

U.S. PATENT DOCUMENTS

| | | | | |
|---|---|---|---|---|
| 2004/0035759 | A1* | 2/2004 | Kokko | B07B 4/04 209/154 |
| 2008/0087583 | A1* | 4/2008 | Van de Laak | A24B 1/04 209/577 |
| 2015/0314335 | A1* | 11/2015 | Davis | B07B 9/00 209/3.1 |

FOREIGN PATENT DOCUMENTS

| | | | | |
|---|---|---|---|---|
| JP | 2009022870 | A * | 2/2009 | B07C 5/02 |
| JP | 2011-092861 | | 5/2011 | |
| WO | WO-2015168495 | A1 * | 11/2015 | B07B 9/00 |

* cited by examiner

COLOR SORTING MACHINE

TECHNICAL FIELD OF THE INVENTION

The present invention relates to a color sorting machine for removing foreign matter in an object to be sorted.

BACKGROUND OF THE INVENTION

Conventionally, there has been known a color sorting machine removing foreign matter in an object to be sorted such as grain (See, for example, Patent Document 1). In this type of color sorting machine, an object to be sorted first flows down on a chute to be released into a sorting region. Next, a detection device applies light to the object to be sorted passing through the sorting region and takes a picture of the object to be sorted to produce an image, and detects foreign matter based on the image. When foreign matter is detected, a removing device ejects compressed air against the detected foreign matter to remove the foreign matter.

An object to be sorted of low specific gravity such as flour, however, does not pass through the sorting region at a fixed speed and on a fixed track due to the air resistance the object receives when the object is released into the sorting region. As a result, in some cases, the compressed air does not hit the detected foreign matter, with the result that the foreign matter cannot be properly removed.

In view of this, a color sorting machine for stably supplying the object to be sorted to a sorting region has been developed (see, for example, Patent Document 2). FIG. 5 shows a color sorting machine which supplies an object to be sorted 200 to a sorting region (a region between transparent walls 800*a* and 800*b* and a foreign matter removing region on the downstream side thereof) by a supply device 100.

The supply device 100 supplies compressed air to an air ejection portion 600 by a compressed air supply portion 400 and ejects compressed air to between a pair of transparent walls 800*a* and 800*b* from an air ejection port 500 via a line groove 700 by the air ejection portion 600. An airflow generated by this compressed air passes between the pair of transparent walls 800*a* and 800*b*. Thus, the object to be sorted 200 is conveyed by the airflow so as to pass between the pair of transparent walls 800*a* and 800*b*. A detection device 300 consists of a light source, an optical sensor, or the like, While the object to be sorted 200 passes between the transparent walls 800*a* and 800*b*, the detection device 300 optically detects foreign matter in the object to be sorted 200 through the transparent walls 800*a* and 800*b*. An ejection nozzle 900 is arranged on the downstream side of the transparent walls 800*a* and 800*b* and when foreign matter is detected, the ejection nozzle 900 ejects compressed air against the detected foreign matter to remove the foreign matter.

The region on the downstream side of the transparent walls 800*a* and 800*b* is enlarged in order to eject compressed air to remove foreign matter, As a result, when the airflow has passed between the transparent walls 800*a* and 800*b*, the airflow is disturbed in the downstream region. That is, in the sorting region, the airflow is unstable. As a result, in the case where the specific gravity of the object to be sorted 200 is lower than that supposed by this color sorting machine, the object to be sorted 200 is dispersed in all directions when it has passed between the transparent walls 800*a* and 800*b*. As a result, the compressed air may not hit the detected foreign matter and the foreign matter may not be properly removed.

PRIOR ART DOCUMENTS

Patent Documents

[Patent Document 1] JP-2011-92861 A
[Patent Document 2] JP-2009-22870 A

SUMMARY OF THE INVENTION

Problems to be Solved by the Invention

It is an object of the present invention to provide a color sorting machine capable of properly removing foreign matter even if the specific gravity of the object to be sorted is low.

Solution to the Problems

According to an embodiment of the present invention, when conveying an object to be sorted along a conveyance route, a color sorting machine sorts a predetermined object in the object to be sorted as foreign matter in a sorting region, and removes the sorted foreign matter into a removal route extending from the sorting region. The color sorting machine is equipped with a supply portion, a sorting portion, a first conveying portion, a second conveying portion, a removing portion, a detection device, a removal device, an air intake port, and a first suction device. The supply portion supplies the object to be sorted to the conveyance route. The sorting portion surrounds the sorting region, and is formed at least partially by a transparent wall. The first conveying portion surrounds the conveyance route from the supply portion to the sorting region, and is hermetically connected to the sorting portion. The second conveying portion surrounds the conveyance route from the sorting region, and is hermetically connected to the sorting portion. The removing portion surrounds the removal route, and is hermetically connected to the sorting portion. The detection device optically detects foreign matter in the object to be sorted being conveyed. The removal device ejects air against the foreign matter in the sorting region in order to remove the detected foreign matter into the removal route. The air intake port is provided in the first conveying portion or the supply portion. The first suction device is provided in the second conveying portion. In the color sorting machine, the sorting portion hermetically surrounds the sorting region except for a portion communicating with the first conveying portion, the second conveying portion, and the removing portion, and the second conveying portion hermetically surrounds the conveyance route from the sorting region to the first suction device, with the first suction device sucking in air in the conveyance route and generating an airflow heading for the second conveying portion from the air intake port via the sorting region.

The color sorting machine may be further equipped with a second suction device provided in the removing portion. The removing portion hermetically surrounds the removal route from the sorting region to the second suction device, and the second suction device sucks in air in the removal route and prevents backflow of foreign matter from the removal route to the sorting region.

According to another embodiment of the present invention, a color sorting machine is equipped with a supply portion, a sorting portion, a first conveying portion, a second conveying portion, a removing portion, a detection device, a route switching device, an air intake port, a first suction device, and a second suction device. The supply portion supplies an object to be sorted to a conveyance route. The sorting portion surrounds a sorting region, and at least a part thereof is formed by a transparent wall. The first conveying portion surrounds the conveyance route from the supply portion to the sorting region, and is hermetically connected to the sorting portion. The second conveying portion surrounds the conveyance route from the sorting region, and is hermetically connected to the sorting portion. The removing portion surrounds a removal route, and is hermetically connected to the sorting portion. The detection device optically detects foreign matter in the object to be sorted conveyed through the transparent wall. When no foreign matter is detected, the route switching device establishes communication between the sorting portion and the second conveying portion, and prohibits communication between the sorting portion and the removing portion. When the foreign matter is detected, the route switching device prohibits communication between the sorting portion and the second conveying portion, and establishes communication between the sorting portion and the removing portion. The air intake port is provided in the first conveying portion or the supply portion. The first suction device is provided in the second conveying portion. The second suction device is provided in the removing portion. In the color sorting machine, the sorting portion hermetically surrounds the sorting region except for a communicating portion between the second conveying portion and the removing portion, the second conveying portion hermetically surrounds the conveyance route from the sorting region to the first suction device, and the removing portion hermetically surrounds the removal route from the sorting region to the second suction device, with the first suction device sucking in the air in the conveyance route to generate an airflow heading for the second conveying portion from the air intake port via the sorting region, and further, the second suction device sucking in the air in the removable route to generate an airflow heading for the removing portion from the sorting region.

The removing portion may have a removal route chamber reducing variation in the airflow of the removal route.

The second conveying portion may have a conveyance route chamber reducing variation in the airflow of the conveyance route.

The second suction device may have a foreign matter cyclone separating foreign matter from a gas.

The first suction device may have a sorted object cyclone separating a sorted object from a gas.

The detection device may have a light source applying light to the object to be sorted through the transparent wall, a camera taking a picture of the object to be sorted to which light is applied so as to produce an image, and an analysis portion detecting foreign matter based on the image.

The color sorting machine may be further equipped with an opening adjusting portion adjusting an air intake amount at the air intake port.

Effect of the Invention

In accordance with the present invention, it is possible to provide a color sorting machine capable of properly removing foreign matter even if the specific gravity of the object to be sorted is low.

More specifically, in the color sorting machine of the present invention, air in the conveyance route is sucked in from the second conveying portion on the downstream side of the sorting portion by the first suction device, thereby generating an airflow passing through the sorting region from the first conveying portion and heading for the second conveying portion. Since the airflow is generated through suction, the airflow is stable while it passes through the sorting region, that is, when foreign matter is detected by detection device, and is removed by the removal device. As a result, even if its specific gravity is low, the object to be sorted is conveyed so as to pass the sorting region in a stable manner due to the airflow, and the removal device can eject air against the foreign matter. Thus, the color sorting machine of the present invention can properly remove foreign matter in the object to be sorted.

DETAILED EXPLANATION OF THE PREFERRED EMBODIMENTS

First Embodiment

The first embodiment of the present invention will be described with reference to the accompanying drawings.

Figure 1A:
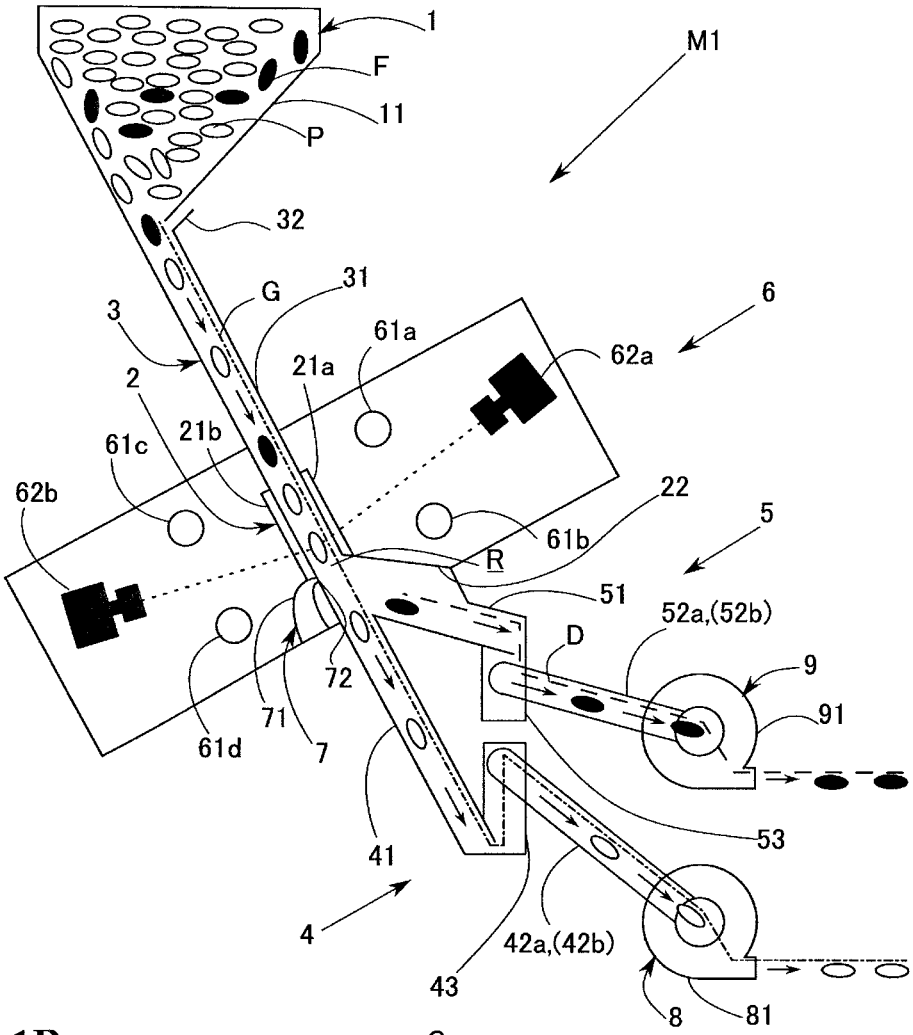
FIG. 1 includes portion A which is a schematic sectional view of a color sorting machine according to a first embodiment of the present invention, and portion B which is an enlarged partial view of the color sorting machine of portion A.

FIG. 1A is a schematic sectional view of a color sorting machine M1 according to the first embodiment of the present invention. The color sorting machine M1 is equipped with a supply portion 1, a sorting portion 2, a first conveying portion 3, a second conveying portion 4, a removing portion 5, a detection device 6, a removal device 7, a first suction device 8, and a second suction device 9. The color sorting machine M1 conveys an object to be sorted along a conveyance route G, and while doing so, removes in a sorting region R a predetermined object in the object to be sorted as foreign matter F into a removal route D extending from the sorting region. R.

The supply portion 1 temporarily stores the object to be sorted, and supplies the object to be sorted to the conveyance route G. The supply portion 1 has a hopper 11, and the object to be sorted flows out of the hopper 11 into the conveyance route G.

The conveyance route G has a predetermined width, and extends from the supply portion 1 while inclined downwards so as to pass through the sorting region R.

Figure 1B:
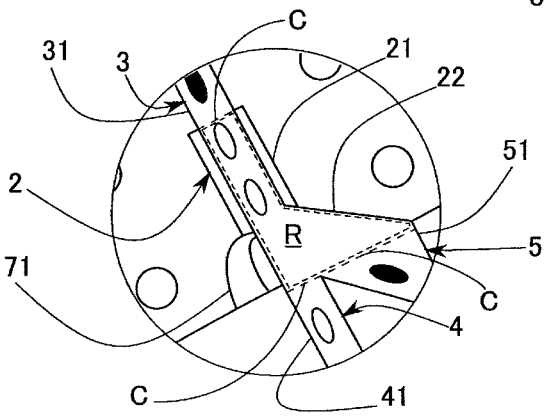

As shown in FIG. 1B, the sorting region R is a region surrounded by phantom line. As described in detail below, in the sorting region R, foreign matter F in the object to be sorted is optically detected by the detection device 6, and is removed into the removal route D by the removal device 7.

The sorting portion 2 surrounds the sorting region R. The sorting portion 2 is formed by a pair of transparent walls 21*a* and 21*b*, and an opaque wall 22.

As shown in FIG 1A, the first conveying portion 3 surrounds the conveyance route G from the supply portion 1 to the sorting portion 2, and is hermetically connected to the sorting portion 2. The first conveying portion 3 is provided with an air intake port 32. The first conveying portion 3 hermetically surrounds the conveyance route G from the air intake port 32 to the sorting region R.

The first conveying portion 3 has a chute 31 arranged in an inclined state between the hopper 11 and the transparent walls 21*a* and 21*b*. The chute 31 is formed as a rectangular duct. The object to be sorted flows down on the inclined surface of the chute 31, whereby the object to be sorted is conveyed along the conveyance route G, and is sent to the sorting region R. The air intake port 32 is formed in the upstream portion of the chute 31. The conveyance route G to the sorting region R is hermetically surrounded by the chute 31 except for the air intake port 32.

Figure 2:
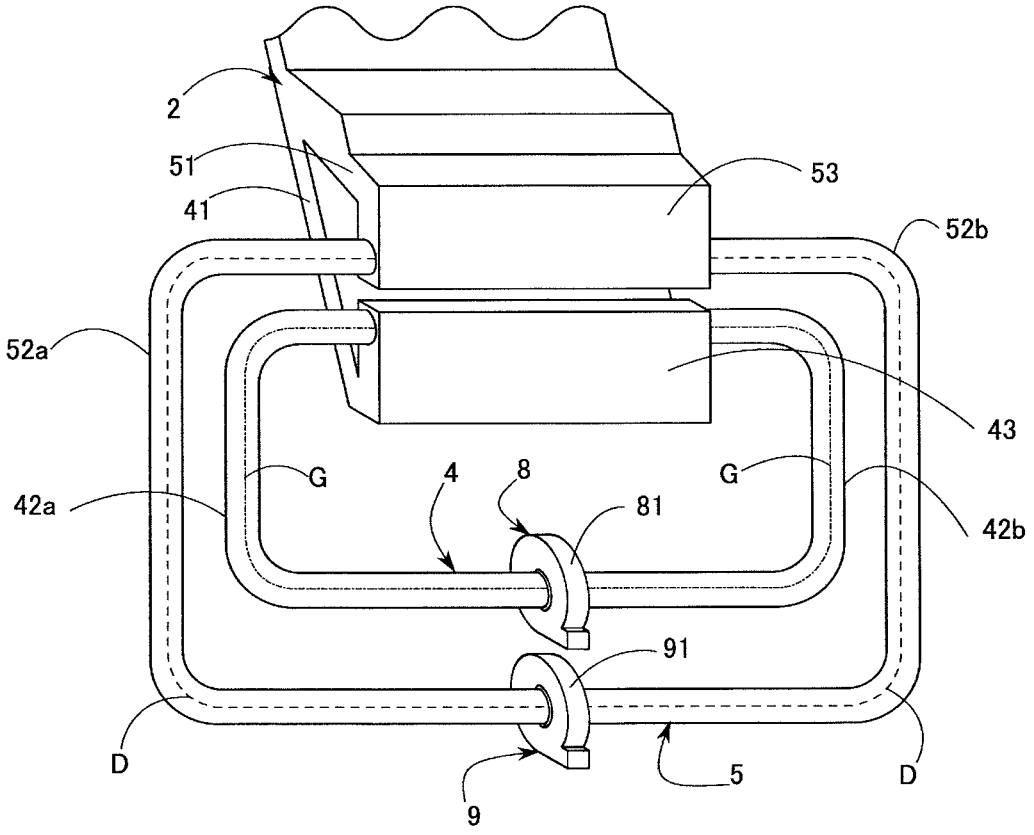
FIG. 2 is an enlarged partial perspective view of the color sorting machine of FIG. 1.

As shown in FIG. 2, the second conveying portion 4 surrounds the conveyance route G from the sorting region R, and is hermetically connected to the sorting portion 2. The second conveying portion 4 hermetically surrounds the conveyance route G from the sorting region R to the first suction device 8.

The second conveying portion 4 has an upstream conveying portion 41, downstream conveying portions 42*a* and 42*b*, and a conveyance route chamber 43. The upstream conveying portion 41 is formed as a rectangular duct. The upstream conveying portion 41 is connected to the sorting portion 2 and the conveyance route chamber 43. The downstream conveying portions 42*a* and 42*b* are formed as hoses. The downstream conveying portions 42*a* and 42*b* are connected to the conveyance route chamber 43 and the first suction device 8. More specifically, the downstream conveying portion 42*a* is connected to one of opposing side walls of the conveyance route chamber 43, and the downstream conveying portion 42*b* is connected to the other of the side walls. Thus, the conveyance route G branches off in two ways from the conveyance route chamber 43, and then unifies at the first suction device 8.

The conveyance route chamber 43 is formed as a box. The section of the conveyance route chamber 43 orthogonal to the conveyance route G is larger than the section of the upstream conveying portion 41 and the downstream conveying portions 42*a* and 42*b* orthogonal to the conveyance route G.

While in this example the conveyance route G branches off in two ways from the conveyance route chamber 43, this is a mere example and should not be construed restrictively. For example, by making the volume of the conveyance route chamber 43 sufficiently large, the conveyance route G does not have to branch off from the conveyance route chamber 43.

The removing portion 5 surrounds the removal route D, and is hermetically connected to the sorting portion 2. The removing portion 5 hermetically surrounds the removal route D from the sorting region R to the second suction device 9.

The removing portion 5 has an upstream removing portion 51, downstream removing portions 52*a* and 52*b*, and a removal route chamber 53. The upstream removing portion 51 is formed as a rectangular duct. The downstream removing portions 52*a* and 52*b* are formed as hoses. The downstream removing portions 52*a* and 52*b* are connected between the removal route chamber 53 and the second suction device 9. More specifically, the downstream removing portion 52*a* is connected to one of opposing side walls of the removal route chamber 53, and the downstream removing portion 52*b* is connected to the other of the side walls. Thus, the removal route D branches off in two ways from the removal route chamber 53, and then unifies at the second suction device 9.

The removal route chamber 53 is formed as a box. The section of the removal route chamber 53 orthogonal to the removal route D is larger than the section of the upstream removing portion 51 and the downstream removing portions 52*a* and 52*b* orthogonal to the removal route D.

While in this example the removal route D branches off in two ways from the removal route chamber 53, this is a mere example and should not be construed restrictively. For example, by making the volume of the removal route chamber 53 sufficiently large, the removal route D does not have to branch off from the removal route chamber 53.

As shown in FIG. 1, the detection device 6 optically detects foreign matter F in the object to be sorted conveyed through the transparent walls 21*a* and 21*b*.

The detection device 6 has a plurality of (four in the present embodiment) light sources 61*a* through 61*d*, cameras 62*a* and 62*b*, and an analysis portion (not shown). The light sources 61*a* through 61*d* apply light to the object to be sorted conveyed through the sorting region R along the conveyance route C through the transparent walls 21*a* and 21*b*. The light sources 61*a* through 61*d* are arranged such that the light sources 61*a* and 61*b* apply light to the object to be sorted from one side, and that the light sources 61*c* and 61*d* apply light to the object to be sorted from the other side. The light sources 61*a* through 61*d* may be fluorescent lamps, LEDs or the like.

Through the transparent wails 21*a* and 21*b*, the cameras 62*a* and 62*b* photograph the object to be sorted to which light is applied so as to produce an image of the object to be sorted. The cameras 62*a* and 62*b* are arranged such that the camera 62*a* photographs the object to be sorted from one side, and that the camera 62*b* photographs the object to be sorted from the other side. While the cameras 62*a* and 62*b* may, for example, be CCD cameras equipped with a line sensor capable of imaging the object to be sorted being conveyed at high speed, this is a mere example and should not be construed restrictively. The analysis portion detects foreign matter F in the object to be sorted based on the image produced by the cameras 62*a* and 62*b*.

The detection device 6 may further have a background that is used as the background of the object to be sorted when the cameras 62*a* and 62*b* takes a picture of the object to be sorted.

The removal device 7 ejects compressed air against the foreign matter F in the sorting region R in order to remove the foreign matter F detected by the detection device 6 into the removal route D.

The removal device 7 has an ejector 71 including an ejection port 72. The ejector 71 is hermetically inserted into the sorting portion 2, and the ejection port 72 thereof is situated in the sorting region R. When the detection device 6 detects the foreign matter F, the ejector 71 ejects compressed air from the ejection port 72 thereof with a predetermined timing, and applies it to the detected foreign matter F. This causes the object to be sorted to be separated into a product P and the foreign matter F in the sorting region R. As a result, the product P is conveyed along the conveyance route as it is, and the foreign matter F is removed from the conveyance route G, and conveyed along the removal route D.

As shown in FIG. 1B, the sorting portion 2 hermetically surrounds the sorting region R except for the communicating portion C communicating with the first conveying portion 3, the second conveying portion 4, and the removing portion 5. As a result, the region from the air intake port 32 to the first suction device 8 and the second suction device 9 are hermetically surrounded.

As shown in FIG. 1A, the first suction device 8 is provided in the second conveying portion 4. The first suction device 8 sucks in the air in the conveyance route G, thereby generating an airflow from the air intake port 32 toward the second conveying portion 4 via the sorting region R. As a result, the space from the air intake port 32 to the first suction device 8 is under negative pressure.

As shown in FIG. 2, the first suction device 8 has a first blower 81. The first blower 81 has an intake port and an exhaust port. The downstream conveying portions 42*a* and 42*b* are connected to the intake port of the first blower 81. The product P is introduced through the intake port of the first blower 81, and is discharged through the exhaust port of the first blower 81.

The second suction device 9 is provided in the removing portion 5. The second suction device 9 sucks in the air in the removal route D, thereby preventing backflow of the foreign matter F from the removal route D to the sorting region R due to the suction by the first suction device 8.

The second suction device 9 has a second blower 91. The second blower 91 has an intake port and an exhaust port. The downstream removing portions 52*a* and 52*b* are connected to the intake port of the second blower 91. The foreign matter F is introduced through the intake port of the second blower 91, and is discharged through the exhaust port of the second blower 91.

In this color sorting machine M1, the first suction device 8 sucks in the air in the conveyance route G from the second conveying portion 4 on the downstream side of the sorting portion 2, thereby generating an airflow from the first conveying portion 3 past the sorting region R and heading for the second conveying portion 4. Since the airflow is generated through suction, the airflow is stable while the airflow passes through the sorting region R, that is, when foreign matter F is detected by the detection device 6 and is removed by the removal device 7.

Further, a conveyance route chamber 43 and a removal route chamber 53 are respectively provided in the second conveying portion 4 and the removing portion 5, whereby variation in the airflow in the conveyance route G and in the removal route D is reduced. As a result, the airflow is further stabilized when passing through the sorting region R.

Thus, even if the specific gravity of the object to be sorted is low, the object to be sorted is conveyed by the airflow so as to stably pass through the sorting region R. As a result, the removal device 7 can reliably eject air against the foreign matter F. Thus, even when the object to be sorted consists, for example, foam beads of a very low specific gravity of 0.02 or less, the removal device 7 can properly remove foreign matter F from among the foam beads.

Further, the first suction device 8 and the second suction device 9 suck in the air in the conveyance route G and the air in the removal route D, whereby it is possible to respectively place the interior of the conveyance route G and the interior of the removal route D under negative pressure. As a result, it is possible to reduce the air resistance the object to be sorted receives. Thus, the object to be sorted is conveyed more stably passing the sorting region R.

Furthermore, the color sorting machine M1 conveys the object to be sorted by airflow, so that, as compared with the conventional color sorting machine, which conveys the object to be sorted by the gravitational force alone, the speed at which the object to be sorted is conveyed is higher. Thus, the speed at which the object to be sorted is sorted is higher.

Further, by conveying the object to be sorted by airflow, it is possible to markedly reduce the remaining amount of the sorted object in the conveyance route G and the removal route D after the sorting of object to be sorted. As a result, the cleaning of the apparatus and the switching of the object to be sorted is facilitated.

Second Embodiment

Subsequently, the second embodiment of the present invention will be described.

Figure 3:
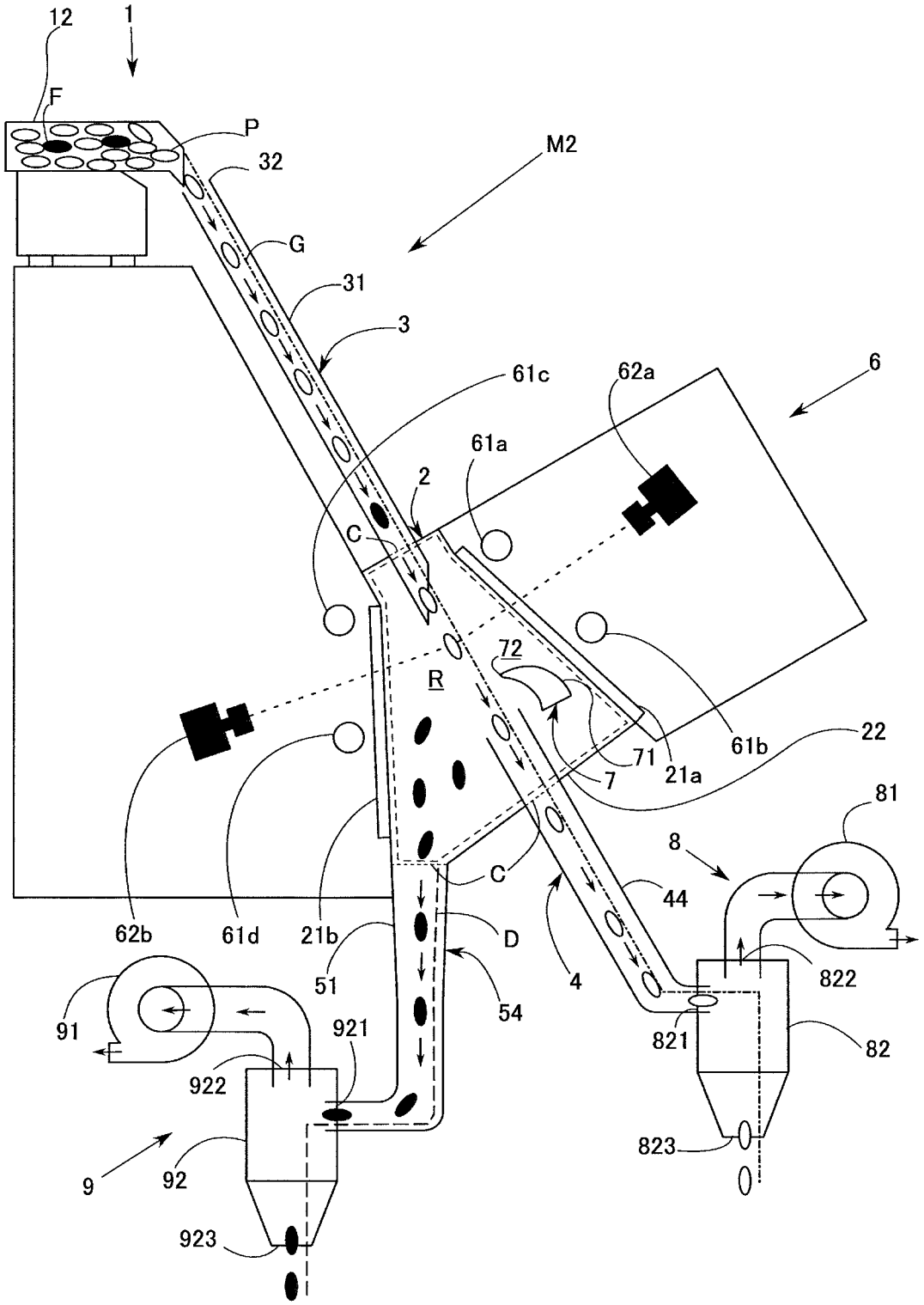
FIG. 3 is a schematic sectional view of a color sorting machine according to a second embodiment of the present invention.

FIG. 3 is a schematic sectional view of a color sorting machine M2 according to the second embodiment of the present invention. The components that are the same as those of the above-described embodiment are indicated by the same reference numerals, and a detailed description thereof will be left out.

The supply portion 1 has a vibration feeder 12 instead of the hopper 11. The vibration feeder 12 vibrates, whereby the object to be sorted flows out of the vibration feeder 12 into the conveyance route G.

In the sorting portion 2, the transparent walls 21*a* and 21*b* are provided so as to be sufficiently spaced away from the conveyance route G.

The air intake port 32 is provided at the upstream end of the chute 31. The object to be sorted flows out of the vibration feeder 12 into the conveyance route G via the air intake port 32.

Instead of the upstream conveying portion 41 and the downstream conveying portions 42*a* and 42*b*, the second conveying portion 4 has a duct-like product conveying portion 44 connected to the sorting portion 2 and the first suction device 8.

Instead of the upstream removing portion 51 and the downstream removing portions 52*a* and 52*b*, the removing portion 5 has a duct-like foreign matter conveying portion 54 connected to the sorting portion 2 and the second suction device 9.

The ejector 71 is provided in the sorting region R so as to be spaced away from the conveyance route G so that the ejector 71 may not hinder the conveyance of the object to be sorted.

The first suction device 8 further has a sorted object cyclone 82. The sorted object cyclone 82 separates the sorted object conveyed via the second conveying portion 4, that is, the product P, from a gas. The sorted object cyclone 82 is formed in a funnel-like tapering downward. The sorted object cyclone 82 has on the upper side thereof an exhaust port 821 connected to the intake port of the first blower 81. The sorted object cyclone 82 further has a product introducing port 822 provided below the exhaust port 821, and a product discharging port 823 provided at the lower end.

The product P is introduced into the sorted object cyclone 82 along with a gas through the product introducing port 822 by the airflow generated by the first blower 81. The introduced product P is attracted downwards by the gravitational force. On the other hand, the gas is sucked through the exhaust port 821 on the upper side of the sorted object cyclone 82. As a result, the product P is separated from the gas, and is discharged through the product discharging port 823 without being introduced into the first blower 81.

The second suction device 9 further has a foreign matter cyclone 92. The foreign matter cyclone 92 is formed in a funnel-like tapering downward. The foreign matter cyclone 92 has on the upper side thereof an exhaust port 921 connected to the intake port of the second blower 91. The foreign matter cyclone 92 further has a foreign matter introducing port 922 provided below the exhaust port 921, and a foreign matter discharging port 923 provided at the lower end.

The foreign matter cyclone 92 separates the foreign matter F from the gas by the same method as that of the sorted object cyclone 82. That is, the foreign matter F is introduced into the foreign matter cyclone 92 from the foreign matter introducing port 922 along with the gas by the airflow generated by the second blower 91. The introduced foreign mater F is attracted downwards by the gravitational force. On the other hand, the gas is sucked through the exhaust port 921. As a result, the foreign matter F is separated from the gas, and is discharged through the foreign matter discharging port 923 without being introduced into the second blower 91.

As in the color sorting machine M1, in this color sorting machine M2 also, it is possible to properly remove foreign matter F in the object to be sorted.

When, for example, the object to be sorted is a pulverized object such as flour, and when the object to be sorted adheres to the transparent walls 21*a* and 21*b*, the detection device 6 cannot detect foreign matter F in the object to be sorted. In this connection, in the color sorting machine M2, the transparent walls 21*a* and 21*b* are sufficiently spaced away from the conveyance route G, whereby adhesion of the object to be sorted to the transparent walls 21*a* and 21*b* is suppressed. Further, due to the provision of the sorted object cyclone 82 and the foreign matter cyclone 92, when the object to be sorted is a pulverized object, the product P and the foreign matter F are easily separated from the gas. Thus, the color sorting machine M2 is suitable for sorting an object to be sorted in the form of a pulverized object.

Third Embodiment

Subsequently, the third embodiment of the present invention will be described.

Figure 4A:
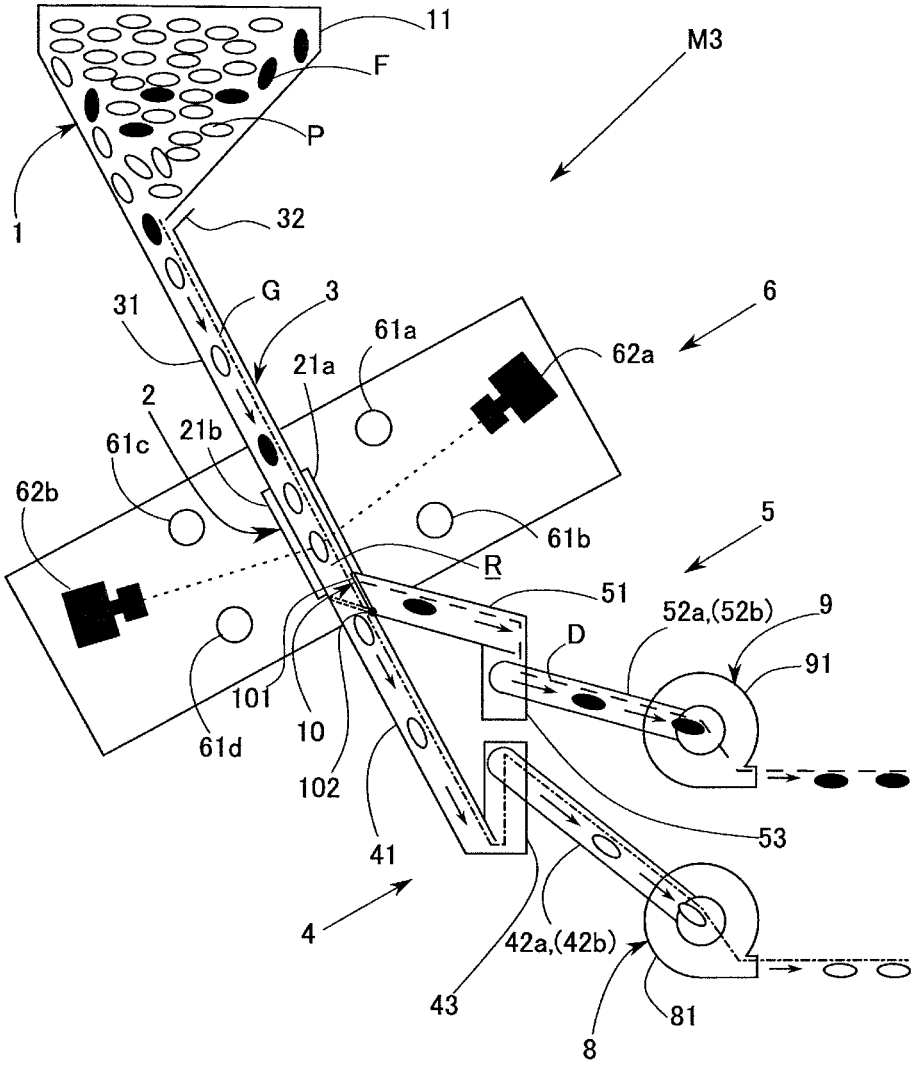
FIG. 4 includes portion A which is a schematic sectional view of a color sorting machine according to a third embodiment of the present invention, and portion B which is an enlarged partial view of the color sorting machine of portion A.

FIG. 4A is a schematic sectional view of a color sorting machine M3 according to the third embodiment of the present invention. The components that are the same as those of the above-described embodiments are indicated by the same reference numerals, and a detailed description thereof will be left out.

Figure 4B:
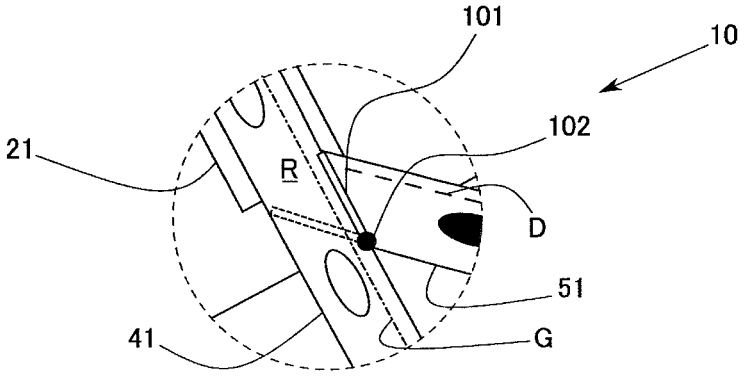
Figure 5:
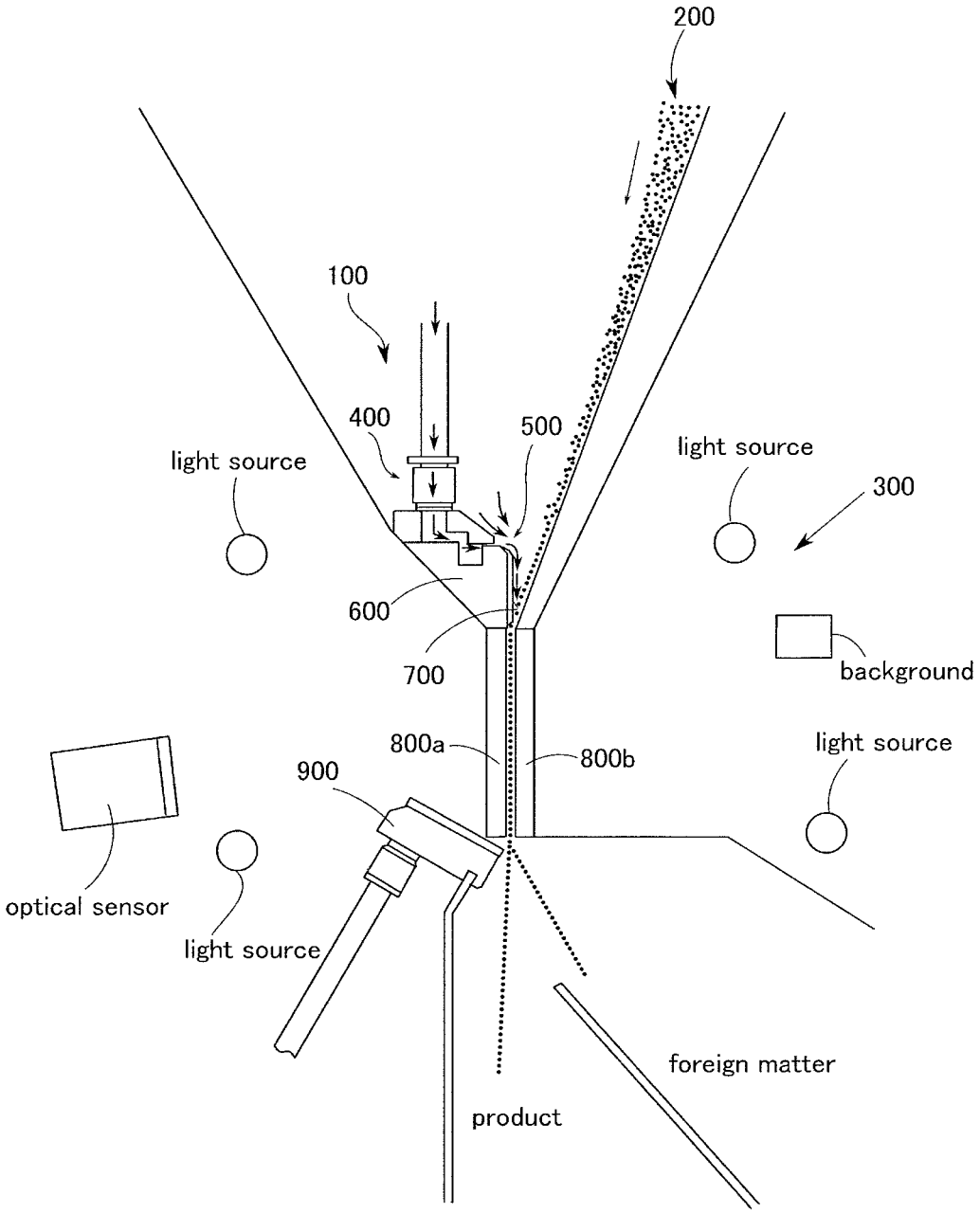
Fig. 5 Prior Art
FIG. 5 is a schematic sectional view of a color sorting machine according to a conventional example.

As shown in FIGS. 4A and 4B, instead of the removal device 7, the color sorting machine M3 is equipped with a route switching device 10. When no foreign matter F is detected, the route switching device 10 establishes communication between the sorting portion 2 and the second conveying portion 4, and prohibits communication between the sorting portion 2 and the removing portion 5. When some foreign matter F is detected, the route switching device 10 prohibits communication between the sorting portion 2 and the second conveying portion 4, and establishes communication between the sorting portion 2 and the removing portion 5.

The route switching device 10 has a valve body 101 and a valve shaft 102. The valve shaft 102 is rotatably provided at the portion where the upstream conveying portion 41 and the upstream removing portion 51 branch off from the sorting portion 2. The valve body 101 is supported by the valve shaft 102, and, through rotation of the valve shaft 102, the valve body 101 can move between a first position indicated by the solid line and a second position indicated by the phantom line.

The color sorting machine M3 sucks in the air in the removal route D by the second suction device 9, thereby generating an airflow heading for the removing portion 5 from the sorting region R.

Next, to be described will be a method by which when the color sorting machine M3 detects foreign matter F, the foreign matter F is removed into the removal route D.

When no foreign matter F is detected, the valve body 101 is at the first position, with the sorting portion 2 and the second conveying portion 4 communicating with each other, and the sorting portion 2 and the removing portion 5 not communicating with each other. As a result, in the color sorting machine M3, it is possible to convey the product P along the conveyance route G by the airflow generated by the first suction device 8.

When some foreign matter F is detected, the valve body 101 moves from the first position to the second position with a predetermined timing, and communication between the sorting portion 2 and the second conveying portion 4 is prohibited, with communication between the sorting portion 2 and the removing portion 5 being allowed. That is, the conveyance route G is cut off by the valve body 101, and the removal route D is opened to the sorting region R. As a result, the color sorting machine M3 can remove the detected foreign matter F into the removal route D from the conveyance route G by the airflow generated by the second suction device 9. After a predetermined period of time has elapsed, the valve body 101 is returned from the second position to the first position.

The above structure of the route switching device 10 is only given by way of example, and should not be construed restrictively. In another possible structure of the route switching device 10, for example, each of the communicating portion between the sorting portion 2 and the second conveying portion 4 and the communicating portion between the sorting portion 2 and the removing portion 5 is provided with a pair of valve shaft and valve body.

As in the color sorting machines M1 and M2, also in this color sorting machine M3, the airflow passing through the sorting region R is stable, and the speed at which the object to be sorted is conveyed is stable. Thus, the color sorting machine M3 can properly remove the detected foreign matter F by the route switching device 10.

The present invention is not restricted to the above-described embodiments but allows modifications as appropriate. For example, the following modifications may be applied to the above-described embodiments, or the above-described embodiments may be combined with the following modifications.

(i) The air intake port 32 may be provided in the supply portion 1. In this case, it is desirable for the first conveying portion 3 to be hermetically connected to the supply portion 1 and the sorting portion 2 and to hermetically surround the conveyance route G to the sorting portion 2.

(ii) The color sorting machines M1 through M3 may be further equipped with an opening adjustment portion adjusting the amount of air taken in through the air intake port 32. The opening adjustment portion can adjust the speed of the airflow generated by the first suction device 8 as appropriate by adjusting the air intake amount. Thus, in the case, for example, where the mixing rate of foreign matter F in the object to be sorted is high, the color sorting machines M1 through M3 adjust the speed of the airflow to reduce the conveying speed of the object to be sorted, thereby enhancing the sorting accuracy.

(iii) The color sorting machines M1 through M3 may be equipped with a filter for removing dust, in the conveyance route G and the removal route D.

DESCRIPTION OF THE REFERENCE CHARACTERS

1 supply portion
11 hopper
12 vibration feeder
2 sorting portion
21*a*, 21*b* transparent wall
22 opaque
3 first conveying portion
31 chute
32 air intake port
4 second conveying portion
41 upstream conveying portion
42*a*, 42*b* downstream conveying portion
43 conveyance route chamber
44 product conveying portion
5 removing portion
51 upstream removing portion
52*a*, 52*b* downstream removing portion
53 removal route chamber
54 foreign matter removing portion
6 detection device
61*a* through 61*d* light source
62*a*, 62*b* camera
7 removal device
71 ejector
72 ejection port
8 first suction device
81 first blower
82 sorted object cyclone
821 exhaust port (sorted object cyclone)
822 product introducing port
823 product discharging port
9 second suction device
91 second blower
92 foreign matter cyclone
921 exhaust port (foreign matter cyclone)
922 foreign matter introducing port
923 foreign matter discharging port
10 route switching device
101 valve body
102 valve shaft
100 conventional supply device
200 object to be sorted in the conventional supply device
300 detection device in the conventional sorting device
400 compressed air supply portion of the conventional supply device
500 air ejection port of the conventional supply device
600 air ejecting portion of the conventional supply device
700 line groove of the conventional supply device
800*a*, 800*b* transparent wall of the conventional supply device
900 ejection nozzle of the conventional sorting device
M1, M2, M3 color sorting machine
G conveyance route
D removal route
R sorting region
P product
F foreign matter
C communicating portion

The invention claimed is:

1. A color sorting machine, when conveying an object to be sorted along a conveyance route, the color sorting machine removing, in a sorting region, a predetermined object in the object to be sorted as foreign matter into a removal route extending from the sorting region, the color sorting machine comprising:

a supply portion supplying the object to be sorted to the conveyance route;

a sorting portion surrounding the sorting region, at least a part of the sorting portion being formed by a transparent wall;

a first conveying portion surrounding the conveyance route from the supply portion to the sorting region and hermetically connected to the sorting portion;

a second conveying portion surrounding the conveyance route from the sorting region and hermetically connected to the sorting portion;

a removing portion surrounding the removal route and hermetically connected to the sorting portion;

a detection device optically detecting the foreign matter in the object to be sorted conveyed through the transparent wall;

a removal device ejecting air against the foreign matter in the sorting region so as to remove the detected foreign matter into the removal route;

an air intake port provided in the first conveying portion or the supply portion; and a first suction device provided in the second conveying portion, wherein the sorting portion hermetically surrounds the sorting region except for the first conveying portion, the second conveying portion, and a portion communicating with the removing portion, wherein the second conveying portion hermetically surrounds a periphery of the conveyance route from the sorting region to the first suction device, and wherein the first suction device sucks in air in the conveyance route, thereby generating an airflow heading for the second conveying portion from the air intake port via the sorting region.

2. The color sorting machine according to claim 1, further comprising a second suction device provided in the removing portion, wherein the removing portion hermetically surrounds a periphery of the removal route from the sorting region to the second suction device, and wherein the second suction device sucks in the air in the removal route, thereby preventing backflow of the foreign matter from the removal route to the sorting region.

3. The color sorting machine according to claim 1, wherein the second conveying portion has a conveyance route chamber reducing variation in the airflow in the conveyance route.

4. The color sorting machine according to claim 1, wherein the first suction device has a sorted object cyclone separating the sorted object from a gas.

5. The color sorting machine according to claim 1, wherein the detection device has a light source applying light to the object to be sorted through the transparent wall, a camera taking a picture of the object to be sorted to which light is applied so as to produce an image, and an analysis portion detecting the foreign matter based on the image.

6. The color sorting machine according to claim 1, further comprising an opening adjustment portion adjusting an amount of air taken in through the air intake port.

7. A color sorting machine, when conveying an object to be sorted along a conveyance route, the color sorting machine removing, in a sorting region, a predetermined object in the object to be sorted as foreign matter into a removal route extending from the sorting region, the color sorting machine comprising:

a supply portion supplying the object to be sorted to the conveyance route;

a sorting portion surrounding the sorting region, at least a part of the sorting portion being formed by a transparent wall;

a first conveying portion surrounding the conveyance route from the supply portion to the sorting region and hermetically connected to the sorting portion;

a second conveying portion surrounding the conveyance route from the sorting region and hermetically connected to the sorting portion;

a removing portion surrounding the removal route and hermetically connected to the sorting portion;

a detection device optically detecting the foreign matter in the object to be sorted conveyed through the transparent wall;

a route switching device allowing communication between the sorting portion and the second conveying portion and prohibiting communication between the sorting portion and the removing portion when no foreign matter is detected, and prohibiting communication between the sorting portion and the second conveying portion and allowing communication between the sorting portion and the removing portion when the foreign matter is detected;

an air intake port provided in the first conveying portion or the supply portion;

a first suction device provided in the second conveying portion; and a second suction device provided in the removing portion, wherein the sorting portion hermetically surrounds the sorting region except for the first conveying portion, the second conveying portion, and a portion communicating with the removing portion, wherein the second conveying portion hermetically surrounds a periphery of the conveyance route from the sorting region to the first suction device, wherein the removing portion hermetically surrounds a periphery of the removal route from the sorting region to the second suction device, wherein the first suction device sucks in air in the conveyance route, thereby generating an airflow heading for the second conveying portion from the air intake port via the sorting region, and wherein the second suction device sucks in air in the removal route, thereby generating an airflow heading for the removing portion from the sorting region.

8. The color sorting machine according to claim 7, wherein the removing portion has a removal route chamber reducing variation in the airflow in the removal route.

9. The color sorting machine according to claim 7, wherein the second suction device has a foreign matter cyclone separating the foreign matter from a gas.

* * * * *